US012669309B2

(12) United States Patent
Murphy et al.

(10) Patent No.: US 12,669,309 B2
(45) Date of Patent: Jun. 30, 2026

(54) LASER DESIGNATOR PODS (LDP)

(71) Applicant: BAE Systems plc, London (GB)

(72) Inventors: Ben Anthony Murphy, Preston (GB); Adrian Duncan Lees, Preston (GB)

(73) Assignee: BAE Systems plc, London (GB)

( * ) Notice: Subject to any disclaimer, the term of this patent is extended or adjusted under 35 U.S.C. 154(b) by 196 days.

(21) Appl. No.: 18/292,192

(22) PCT Filed: Jul. 29, 2022

(86) PCT No.: PCT/GB2022/052015

§ 371 (c)(1),
(2) Date: Jan. 25, 2024

(87) PCT Pub. No.: WO2023/012464

PCT Pub. Date: Feb. 9, 2023

(65) Prior Publication Data

US 2025/0123078 A1 Apr. 17, 2025

(30) Foreign Application Priority Data

Aug. 6, 2021 (EP) ..... 21275105
Aug. 6, 2021 (GB) ..... 2111359

(51) Int. Cl.
*F41G 7/22* (2006.01)
*F41G 7/00* (2006.01)

(52) U.S. Cl.
CPC ..... *F41G 7/226* (2013.01); *F41G 7/001* (2013.01); *F41G 7/2293* (2013.01)

(58) Field of Classification Search
CPC ..... F41G 7/226; F41G 7/001; F41G 7/2293
See application file for complete search history.

(56) References Cited

U.S. PATENT DOCUMENTS 3,752,587 A * 8/1973 Myers ..... F41G 3/326 356/141.3
3,923,273 A * 12/1975 Alpers ..... F41G 7/007 250/203.5
3,942,894 A * 3/1976 Maier ..... G01B 11/26 356/138
4,155,096 A 5/1979 Beauregard
4,349,838 A * 9/1982 Daniel ..... G01S 3/7864 244/3.13

(Continued)

FOREIGN PATENT DOCUMENTS

CN 112729537 A 4/2021
EP 1892507 A1 2/2008

(Continued)

OTHER PUBLICATIONS

European Search Report for Application No. 21275105.1 mail date Jan. 15, 2022, 15 pages.

(Continued)

*Primary Examiner* — Marisa V Conlon
(74) *Attorney, Agent, or Firm* — Maine Cernota & Curran

(57) ABSTRACT

A Laser Designator Pod (LDP) protective system, the LDP protective system comprising: a protective hood a laser detector arranged within the protective hood to generate a signal when exposed to laser radiation within a predefined range of wavelengths; and a computing device to record the generated signal.

15 Claims, 4 Drawing Sheets

(56) References Cited

U.S. PATENT DOCUMENTS

| | | | | |
|---|---|---|---|---|
| 4,737,028 | A * | 4/1988 | Smith | G01S 17/66 244/3.13 |
| 4,917,490 | A * | 4/1990 | Schaffer, Jr. | F41G 3/145 250/341.8 |
| 5,251,003 | A | 10/1993 | Vigouroux | |
| 5,577,733 | A * | 11/1996 | Downing | F41J 1/10 250/222.2 |
| 5,734,466 | A | 3/1998 | George | |
| 5,999,210 | A * | 12/1999 | Nemiroff | F41J 5/08 348/135 |
| 6,587,191 | B2 * | 7/2003 | Greenfield | F41G 3/326 244/3.13 |
| 8,766,152 | B1 * | 7/2014 | Flowers | F41G 3/145 250/353 |
| 2009/0100995 | A1 | 4/2009 | Fisher | |

FOREIGN PATENT DOCUMENTS

| | | |
|---|---|---|
| JP | 2013016689 | 1/2013 |
| JP | 2015197331 | 11/2015 |
| JP | 2016172285 | 9/2016 |
| JP | 2017177152 | 10/2017 |
| WO | 2006126544 | 11/2006 |
| WO | 2021021323 | 2/2021 |

OTHER PUBLICATIONS

GB Search Report for Application No. GB2111359.2 mail date Jun. 7, 2022, 3 pages.

International Search Report and Written Opinion for International Application No. PCT/GB2022/052015 mail date Oct. 6, 2022, 11 pages.

* cited by examiner

LASER DESIGNATOR PODS (LDP)

RELATED APPLICATIONS

This application is a national phase application filed under 35 USC § 371 of PCT Application No. PCT/GB2022/052015 with an International filing date of Jul. 29, 2022, which claims priority of GB Patent Application 2111359.2 filed Aug. 6, 2021 and EP patent application Ser. No. 21/275,105.1 filed Aug. 6, 2021. Each of these applications is herein incorporated by reference in its entirety for all purposes.

FIELD

The present invention relates to Laser Designator Pods (LDP), which are target designation tools used by ground-attack aircraft for identifying targets and guiding precision guided munitions (PGM) such as laser-guided bombs to those targets. Such pods are usually fitted to an aircraft and are used to illuminate a target by firing a laser beam at the target. When a target is so marked by a designator, the laser signal reflects off the target into the sky, where the reflections are detected by a seeker device on the PGM, which steers itself towards the centre of the reflected signal.

BACKGROUND

It is necessary, during commissioning and possibly at a later time, to perform Electromagnetic Compatibility (EMC) Testing on the LDP and/or the aircraft to which it is fitted. As part of that testing, there is a possibility that the laser may be unintentionally fired. Similarly, there may be tests which require the laser to be intentionally fired. In either case, the firing of the laser in a test environment can be dangerous, especially to staff working in the vicinity of the test.

In the case of an unexpected and unintentional firing, personnel in the vicinity may be exposed to risk of harmful levels of laser radiation, which could, in particular, damage eyesight.

As such, when EMC or other testing is performed in connection with LDPs, special precautions are typically taken. Such precautions include the fitting of a safety hood to cover the operational portion(s) of the LDP, such that laser radiation cannot escape from the confines of the hood i.e. the hood is opaque to a range of wavelengths, for example, visible light. Such a situation is shown in FIGS. 1*a* and 1*b*.

FIG. 1*a* shows an LDP 1 and safety hood 10. Before testing commences, the safety hood 10 is fitted to the LDP 1, as shown. Once the hood 10 is fitted to the LDP 1, as shown in FIG. 1*b*, any laser emissions cannot escape the safety hood, thereby protecting any personnel in the vicinity. The fitting of the safety hood 10 may involve securely fastening it in place using bolts, screws, straps or other fastenings. Such fastenings may be arranged to couple with complementary fastenings on the LDP itself.

However, a problem with this arrangement is that once the hood 10 is fitted to the LDP 1, it is not possible to discern whether the laser has fired within the confines of the hood. It is desirable to know if this has happened as it may indicate a degree of malfunction which requires rectification.

A prior art technique employed to address this issue involves the use of so-called Laser Detection Paper, such as that produced by Zeiss®, which is fitted to the hood 10 before fitting. Paper of this sort is sensitized and records a mark in the event of incident laser radiation. In order to detect a firing, the hood must be removed, and the paper examined.

However, there are issues associated with this approach which render it non-optimal. The paper itself is believed to be no-longer available and so it is difficult or impossible to obtain supplies. Even if available, the paper is only useful for recording relatively long bursts of laser radiation in the range of 10-20 secs. As such, if the laser fires for less than 10 secs, such a firing may not be detected by the paper. Further, such a technique is unable to detect the wavelength of the fired laser.

A further approach, adopted by Leonardo®, involves the use of fibre optics which are connected to the hood 10. However, trials have suggested that this approach is not always able to detect a firing at certain wavelengths and/or angles of incidence. This means that it may not be possible to successfully register every unintentional firing of the laser in this situation.

It is an aim of embodiments of the present invention to address shortcomings in the prior art, whether mentioned herein or not.

SUMMARY

According to an aspect of the present invention, there is provided a Laser Designator Pod (LDP) protective system, the LDP protective system comprising a protective hood; a laser detector arranged within the protective hood to generate a signal when exposed to laser radiation within a predefined range of wavelengths; and, a computing device to record the generated signal.

Preferably, the system is suitable for fitting over the LDP. Preferably, the computing device is a Rasberry Pi computing device.

Advantageously, the system provides protection to users during testing of the LDP from harmful laser radiation and provides an indication that the laser within the LDP has correctly fired. Further, the system provides an indication that the laser has correctly fired within a predefined range of wavelengths, that is to say, that the system provides a positive confirmation that the laser of the LDP is operating at the correct desired wavelength. The present inventors have found that the system provides a small, low complexity and low cost solution to testing LDP's that allows the LDP to be tested in-situ without the need for specialist equipment in RF testing chambers.

In an arrangement, the laser detector and the computing device are physically separated, with the laser detector being arranged for use within the hood and the computing device being arranged for use outside the hood.

Advantageously, this allows the computing device to be located some distance away from the laser detector, for example in a less confined space or an office environment.

In an arrangement, the laser detector and the computing device are electrically connected by means of a cable. Advantageously, connection by a cable may assist in avoiding additional possible sources of EM interference. Preferably, the laser detector and the computing device are electrically connected by an EMC shielded cable.

In an arrangement, power is provided to the system by means of a portable battery pack, a mains to DC convertor or Power over Ethernet, PoE.

Advantageously, the battery pack allows the system to be conveniently powered by conventional mains electricity or, where mains power is unavailable, by low power sources such as DC power or PoE which may be more readily accessible in an aircraft maintenance environment.

In an arrangement, the laser detector is provided with an optical emitter operable at a wavelength within the predefined range of wavelengths and arranged to function in a self-test mode.

In an arrangement, the laser detector is provided with a further optical emitter arranged to emit light at a wavelength outside the predefined range of wavelengths to indicate a power-on status of the system.

According to a second aspect, there is provided a Laser Designator Pod comprising the system of the first aspect.

In an arrangement, the predefined range of wavelengths of the first aspect correspond with a range of wavelengths emitted by a laser in the LDP.

In an arrangement, the system of the first aspect is arranged to indicate that the laser in the LDP (1) has fired and that the laser is operating within the predefined range of wavelengths.

In an arrangement, the system is configured to detect a plurality of predefined wavelength ranges, each of the plurality of predefined wavelength ranges corresponding to an operational mode of the LDP, each operational mode comprising a discreet range of predefined wavelengths.

Advantageously, this arrangement allows the system to detect if the LDP is operating in the correct operational mode.

In an arrangement, the predefined wavelength ranges correspond to three operational modes of the LDP, the operational modes comprising:

- a training mode comprising a predefined wavelength in the range of from 1200 to 1700 nm;
- a combat mode comprising a predefined wavelength in the range of from 800 to 1200 nm;
- and a marker mode comprising a predefined wavelength in the range of from 500 to 1100 nm.

Advantageously, this arrangement allows the system to better detect if the LDP is operating in the correct operational mode.

In an arrangement, the system is arranged for communication with a further computing device via a wired or wireless connection wherein the further computing device is arranged to execute a program to perform a test procedure on the LDP.

According to a third aspect of the present invention, there is provided a method of detecting laser fire within a protective hood fitted over a Laser Designator Pod, LDP, using the system according to the first aspect and comprising the steps: providing the laser detector within the hood; performing a test on the LDP; detecting the presence of a fired laser within a predefined range of wavelengths; wherein the predefined range of wavelengths correspond with a range of wavelengths emitted by a laser in the LDP; generating a signal in response to the laser detector being exposed to laser radiation within the predefined range of wavelengths; and recording the generated signal using a computing device.

The test comprises firing the laser within the LDP and detecting, via the LDP protective system, if the LDP is operating correctly within the predefined range of wavelengths. Advantageously, the system provides protection to users during testing of the LDP from harmful laser radiation and provides an indication that the laser within the LDP has correctly fired. Further, the system provides an indication that the laser has correctly fired within a predefined range of wavelengths, that is to say, that the system provides a positive confirmation that the laser of the LDP is operating at the correct desired wavelength According to an aspect of the present invention, there is provided a

- device for detecting laser fire within a protective hood fitted over a Laser Designator Pod, LDP, comprising: a laser detector arranged within the hood to generate a signal when exposed to laser radiation within a predefined range of wavelengths; a computing device to record the signal, thereby indicating that a laser in the LDP has fired.

In an embodiment, the laser detector and the computing device are physically separated, with the laser device being arranged for use within the hood and the computing device being arranged for use outside the hood.

In an embodiment, the laser detector and the computing device are electrically connected by means of a cable.

In an embodiment, power is provided to the device by means of a portable battery pack, a mains to DC convertor or Power over Ethernet, PoE.

In an embodiment, the predefined range of wavelengths is substantially aligned with a plurality of operational modes of the LDP.

In an embodiment, the range is substantially 500 nm to 1700 nm.

In an embodiment, the laser detector is provided with an optical emitter operable at a wavelength within the predetermined range of wavelengths and arranged to function in a self-test mode.

In an embodiment, the laser detector is provided with a further optical emitter arranged to emit light at a wavelength outside the predetermined range of wavelengths to indicate a power-on status of the device.

In an embodiment, the device is arranged for communication with a further computing device arranged to execute a program to perform a test procedure on the LDP.

According to another aspect of the present invention, there is provided a method of detecting laser fire within a protective hood fitted over a Laser Designator Pod, LDP, using the device of any preceding claim and comprising the steps: providing the laser detector within the hood; performing a test on the LDP; monitoring for the presence of a fired laser.

BRIEF DESCRIPTION OF THE FIGURES

Embodiments of the invention will now be described by way of example only with reference to the figures, in which.

DETAILED DESCRIPTION

Figure 1A:
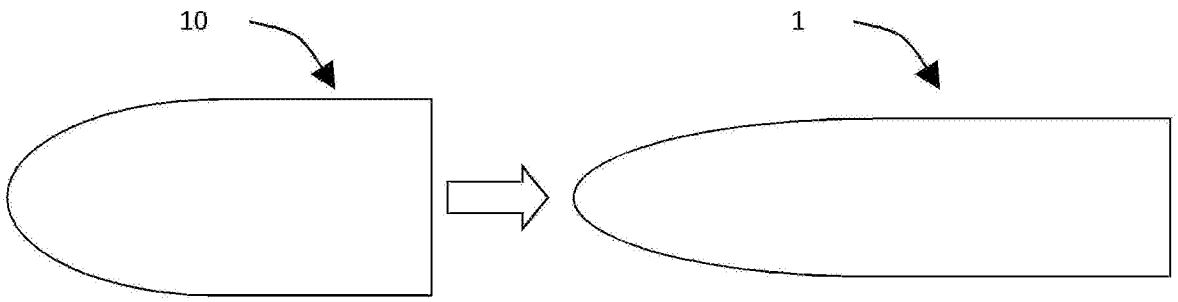
FIGS. 1*a* and 1*b* show a prior art arrangement including an LDP and safety hood.
Figure 1B:
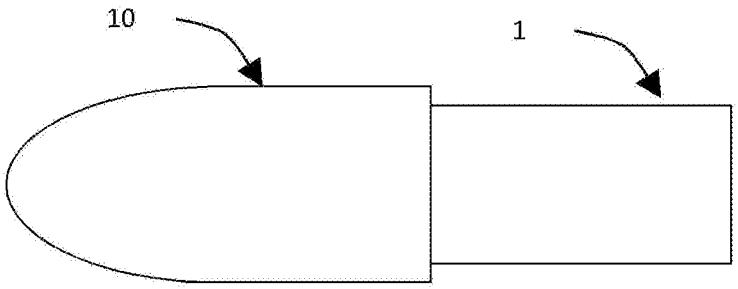
Figure 2:
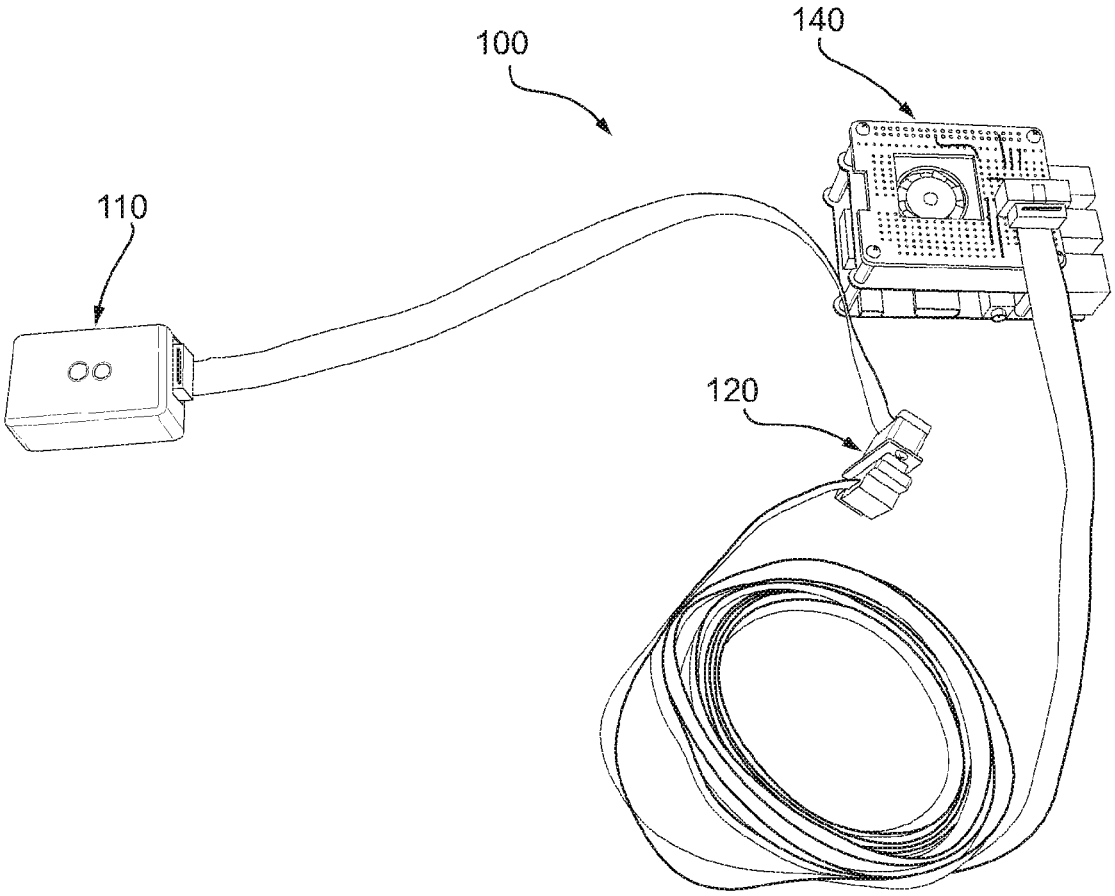
FIG. 2 shows a system according to an embodiment of the invention.

FIG. 2 shows a system 100 according to an embodiment of the present invention. The system 100 is arranged to be partially installed inside the hood 10, and to communicate with an external computer to report any instances of laser firing within the hood.

Figure 3:
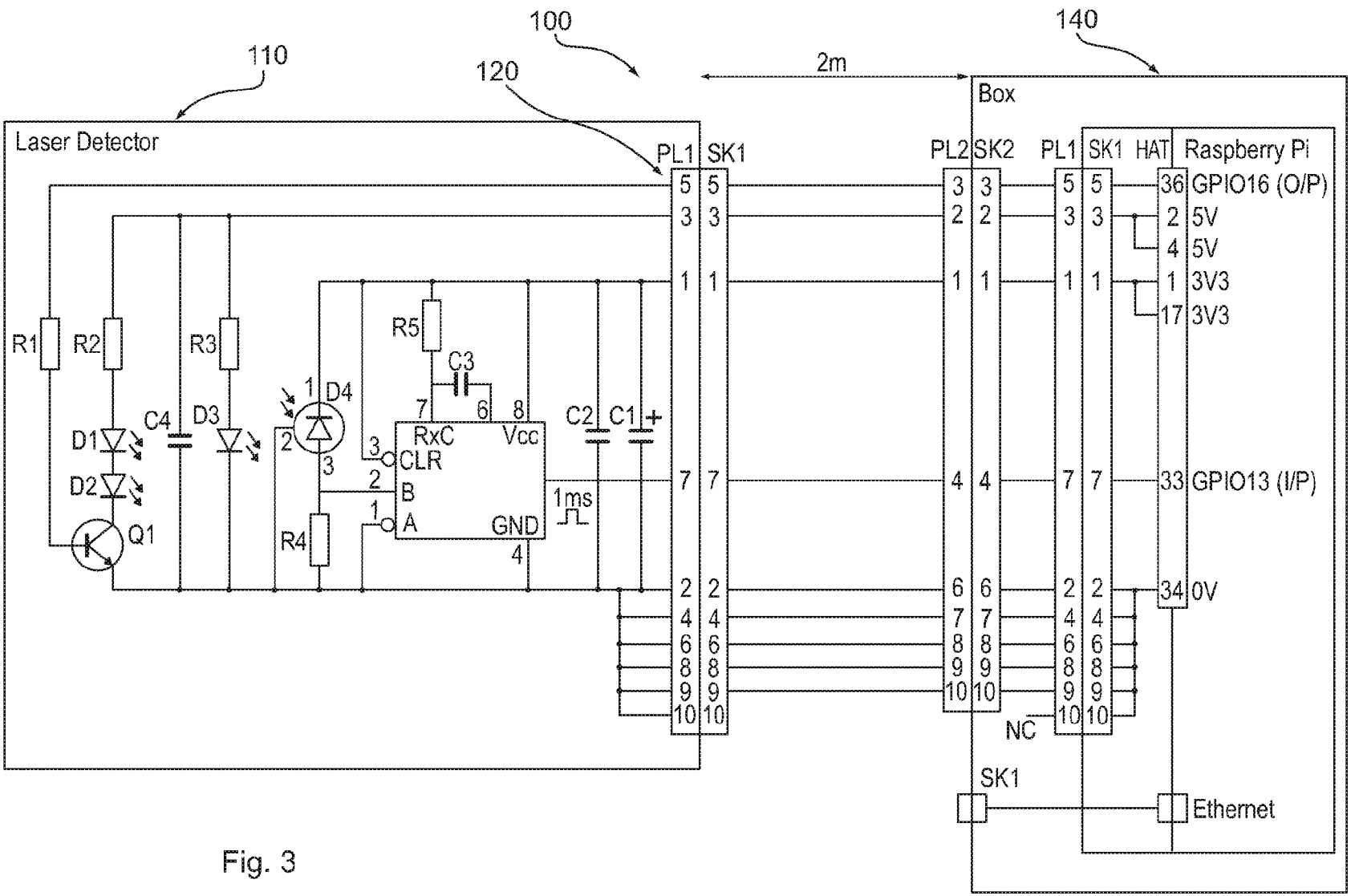
FIG. 3 shows a circuit schematic for the system of FIG. 2, according to an embodiment of the present invention.

FIG. 3 shows a circuit schematic of various features of the system 100 and both FIGS. 2 and 3 are referred to in the following description.

In more detail, the system 100 comprises a laser detector 110 which is arranged within the interior of the hood 10. The laser detector comprises an optical sensor D4, which is sensitive to laser radiation at a wavelength of transmission. Upon receipt of laser radiation at optical sensor D4, a voltage is presented at an input of integrated circuit U1 which is operable to create a 1 ms pulse which is transmitted via means of a cable 120 to a computing device 140, which is located outside the hood 10.

U1 is a 'monostable multivibrator' (part number 74LVC1G123DP). When powered from a supply between 3.0V & 3.6V the shortest pulse that U1 is guaranteed to detect (across R4) is 3 ns. The duration of the electrical pulse generated by D4 across R4 is dependent on:

i. The power of the light incident on the detector (More power=shorter light pulse required to trigger U1)
ii. The duration of the incident light pulse
iii. The wavelength of the incident light pulse (Shorter wavelength=longer light pulse required to trigger U1)
iv. Circuit capacitance (higher capacitance=longer light pulse required to trigger U1)
v. The resistance of R4 (Higher resistance=shorter light pulse required to trigger U1)

The optical detector D4 is a photodiode which is sensitive to wavelengths in the range of 500 nm to 1700 nm. If light from the laser, within this range of wavelengths, falls on the detector D4, then this causes a current to flow through resistor R4. This creates a voltage that is sensed by pin 2 of U1. If this voltage is greater than about 2V then U1 will output a single 3V3 pulse with a duration set by resistor R5 & capacitor C3 (approximately 1 ms). This pulse is used to set an interrupt to the computing device 140, which is described later.

The light falling on D4 must be removed, to a level where the voltage on U1 pin 2 is less than about 1V, and then re-applied in order to cause U1 to output another pulse. Thus, the computing device 140 is interrupted each time a new light pulse is detected. The software running on an external computer (not shown) connected to the computing device 140 can then measure the time between successive pulses to distinguish between the Marker and either the Combat or Training Lasers, which represent different operational modes of the LDP. If the Pulse Repetition Frequency, PRF, of the combat & training lasers are sufficiently different from each other, then the computing device 140 will be able to distinguish between them.

The laser detector 110 is connected, through the body of the hood 10, via a length of electrical cable 120, such as multi-connector ribbon cable, to the computing device 140, such as a Raspberry Pi. The computing device receives the 1 ms pulse generated by the laser detector 110 at a General Purpose Input/Output (GPIO) pin. Receipt of this pulse triggers a hardware interrupt which can be registered and processed by a further external computing device (not shown) which is connected to the computing device 140. The connection from the computing device 140 to the further external computer device may be effected by a further wired connection, such as Ethernet, fibre optic, or, where possible, via a wireless connection, such as Wi-Fi.

Power may be provided to the system 100 via a portable battery pack, a mains to DC convertor or Power over Ethernet (POE).

The further external computer device, which is arranged to run software associated with the ongoing testing of the LDP, is therefore alerted to the firing of the laser in the LDP, even though there is no physical access to the interior of the hood 10. Such a firing may be intentional or not, but the fact that it may be reliably detected and recorded allows an operator to take any corrective action which may be required. The corrective action may involve further tests and/or remedial action.

When the computing device, 140, GPIO output 16 is set high, then transistor Q1 will turn on and cause Infra-Red IR emitters D1 & D2 to illuminate. The light from D1 & D2 will then illuminate D4, simulating the laser light produced by the LDP. This will allow the computing device 140 software to perform a built-in test. D1 & D2 emit light with a wavelength between 900 nm & 1000 nm. These devices are eye safe and so there is no risk to personnel if these are used outside the confines of the hood 10.

D3 is a 'Power-On' LED that emits in the visible spectrum. A blue LED is preferably used so that its spectrum (400 nm to 600 nm) is not detected by D4 and so does not interfere with the normal operation of the system 100. In one test set up, a visible-light camera which forms a part of the LDP is able to see the blue light, thus confirming power is being supplied to system 100.

In one embodiment, the laser detector 110 is fitted inside the hood 10 at the time of manufacture of the hood so that it is a truly integral part of the hood. Alternatively, the laser detector 110 may be retro-fitted to an existing hood 10.

The exact location of the laser detector 110 inside the hood is relatively unimportant, since the laser radiation typically reflects around and effectively illuminates the entire interior. As such, the laser detector can be located at any convenient location. Some trial and error may be required to find the optimum position. However, it is not necessary for the laser to be directly incident on the detector.

Since the LDP, when undergoing EMC testing, is located in a very delicate environment, from an EMC point of view, care is required in the design and manufacture of the system 100. As such, screened and wired connections are preferred over wireless links and battery power is preferred over mains power. Such steps can assist in avoiding additional possible sources of EM interference.

Figure 4:
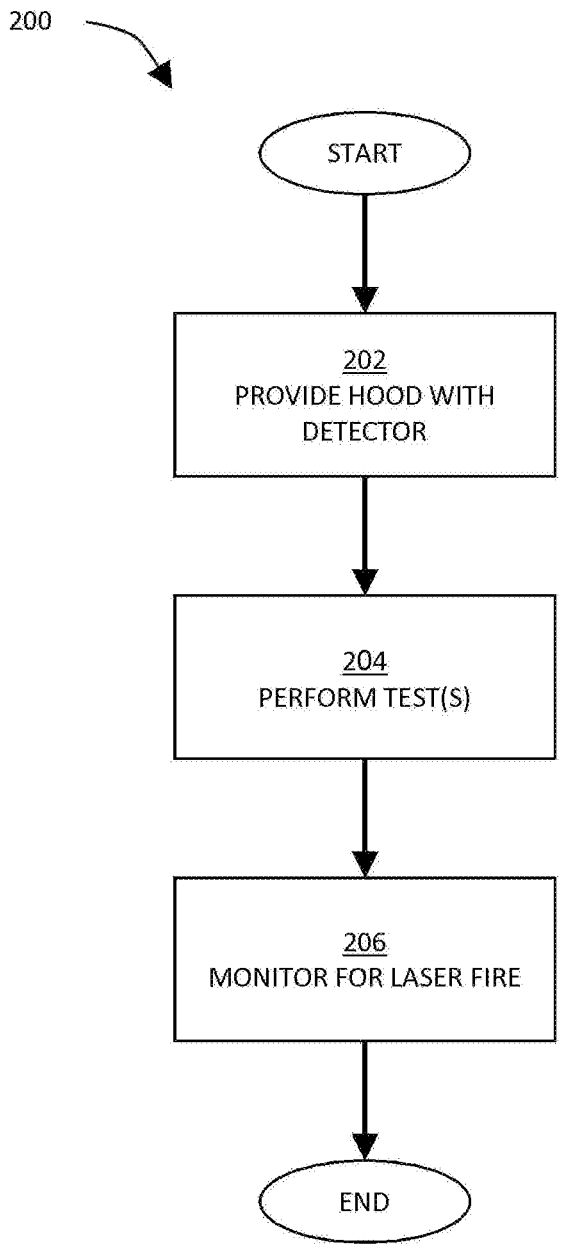
FIG. 4 shows a flowchart of a method according to an embodiment of the present invention.

FIG. 4 shows a flowchart depicting the steps of a method 200 according to an embodiment of the present invention. At 202, a hood 10 is provided, which comprises a laser detector 110. The laser detector may be integrally formed with the hood or it may be retro-fitted at a later time.

At 204, the EMC test is performed on the LDP or aircraft. At 206, the computing device 140 continually monitors the laser detector to determine if a pulse signal is generated, which is indicative of a fired laser within the hood. As a part of the monitoring process, an operator is able to determine whether the test should be completed or terminated and whether any remedial action is required.

By means of an embodiment 100 as set out above, it is possible to monitor an interior space of a protective hood 10 fitted to an LDP 1 when undergoing testing, especially EMC testing. Such an arrangement permits reliable monitoring of laser activity, whether intentional or not, thereby ensuring that the LDP is operating within permitted limits.

The invention claimed is:

1. A Laser Designator Pod (LDP) protective system, the LDP protective system comprising:

a protective hood;

a laser detector arranged within the protective hood to generate a signal when exposed to laser radiation within a predefined range of wavelengths; and, a computing device to record the generated signal, wherein the protective hood is opaque to laser radiation within the predefined range of wavelengths.

2. The system of claim 1 wherein the laser detector and the computing device are physically separated, with the laser detector being arranged for use within the protective hood and the computing device being arranged for use outside the protective hood.

3. The system of claim 2 wherein the laser detector and the computing device are electrically connected by means of a cable.

4. The system of claim 1, wherein power is provided to the system by means of a portable battery pack, a mains to DC convertor, or Power over Ethernet (PoE).

5. The system of claim 1, wherein the laser detector is provided with an optical emitter operable at a wavelength within the predefined range of wavelengths and arranged to function in a self-test mode.

6. The system of claim 5 wherein the laser detector is provided with a further optical emitter arranged to emit light at a wavelength outside the predefined range of wavelengths to indicate a power-on status of the system.

7. The LDP protective system of claim 1, wherein the laser detector is a photodiode sensitive to wavelengths in the range of 500-1700 nm.

8. The LDP protective system of claim 1, wherein the computing device is configured to indicate a detected signal and report an associated wavelength and/or wavelength range, and/or pulse repetition frequency, and/or operating mode of the LDP.

9. A Laser Designator Pod (LDP) comprising the system according to claim 1.

10. The LDP of claim 9 wherein the predefined range of wavelengths correspond with a range of wavelengths emitted by a laser in the LDP.

11. The LDP of claim 10, wherein the system is arranged to indicate that the laser in the LDP has fired and that the laser is operating within the predefined range of wavelengths.

12. The LDP of claim 9, wherein the system is configured to detect a plurality of predefined wavelength ranges, each of the plurality of predefined wavelength ranges corresponding to an operational mode of the LDP, each operational mode comprising a discreet range of predefined wavelengths.

13. The LDP of claim 12 wherein the predefined wavelength ranges correspond to three operational modes of the LDP, the operational modes comprising:

a training mode comprising a predefined wavelength in the range of from 1200 to 1700 nm;

a combat mode comprising a predefined wavelength in the range of from 800 to 1200 nm; and a marker mode comprising a predefined wavelength in the range of from 500 to 1100 nm.

14. The LDP according to claim 9, wherein the system is arranged for communication with a further computing device via a wired or wireless connection wherein the further computing device is arranged to execute a program to perform a test procedure on the LDP.

15. A method of detecting laser fire within a protective hood fitted over a Laser Designator Pod (LDP) using the Laser Designator Pod (LDP) protective system of claim 1, the method comprising:

providing the laser detector within the protective hood;

performing a test on the LDP;

detecting the presence of a fired laser within a predefined range of wavelengths; wherein the predefined range of wavelengths correspond with a range of wavelengths emitted by a laser in the LDP;

generating a signal in response to the laser detector being exposed to laser radiation within the predefined range of wavelengths; and recording the generated signal using a computing device.

* * * * *